United States Patent [19]

Craig et al.

[11] 4,439,138

[45] Mar. 27, 1984

[54] COMBUSTION CONTROL APPARATUS

[75] Inventors: Glenn D. Craig, Menomonee Falls; Ronald K. Wilhelm; Roy M. Rulseh, both of Milwaukee, all of Wis.

[73] Assignee: Aqua-Chem, Inc., Milwaukee, Wis.

[21] Appl. No.: 914,348

[22] Filed: Jun. 12, 1978

[51] Int. Cl.[3] ..... F23N 1/00; F23N 5/00

[52] U.S. Cl. ..... 431/12; 431/76; 236/15 E

[58] Field of Search ..... 431/12, 76, 63, 90; 236/15 E, 15 BD; 123/32 EE

[56] References Cited

U.S. PATENT DOCUMENTS

| | | | |
|---|---|---|---|
| 2,269,674 | 1/1942 | Liddel et al. | 236/15 E |
| 2,408,114 | 9/1946 | Urquhart | 236/15 E |
| 3,241,597 | 3/1966 | Juzi | 431/76 X |
| 3,503,553 | 3/1970 | Schomaker | 431/76 X |
| 3,549,089 | 12/1970 | Hamlett | 431/12 X |
| 3,556,700 | 1/1971 | Jackson et al. | 431/12 |
| 3,723,047 | 3/1973 | de Livois | 431/76 |
| 3,814,570 | 6/1974 | Guigues et al. | 431/76 |
| 3,861,855 | 1/1975 | Seider | 431/76 |
| 3,920,399 | 11/1975 | Meyer | 236/15 E X |
| 4,157,238 | 6/1979 | Van Berkum | 431/12 |

*Primary Examiner*—Samuel Scott
*Assistant Examiner*—Randall L. Green

[57] ABSTRACT

A combustion device includes a fuel-air ratio controller. A control is coupled to receive a first signal functionally related to the status of the fuel-air controller and a second signal from an oxygen sensor which is functionally related to the oxygen in the discharge gases from the combustion zone. The control is operative to provide an output signal to a fuel regulator for adjusting the fuel delivered to the combustion zone in relation to the oxygen in the discharge gases.

12 Claims, 5 Drawing Figures

COMBUSTION CONTROL APPARATUS

BACKGROUND OF THE INVENTION

This invention relates to combustion devices and more particularly to a controller for insuring optimum combustion conditions.

In most practical combustion devices, fuels are selected for use in a manner that is most compatible with the specific apparatus design, the fuel is conditioned so that it is readily combustible and ambient air is provided as the oxidizer. Both the fuel and air are delivered to a combustion space which is generally enclosed for optimum control of the combustion process and to facilitate the utilization of the heat being produced. The quantities of fuel and air delivered to the combustion enclosure are commonly metered or otherwise controlled to increase combustion efficiency. One important factor in determining such efficiency is the quantity and quality of the oxidizer. Ideally, only a stoichiometric amount of oxygen should be supplied to the reaction zone. Under stoichiometric conditions, the excess gases that are heated to combustion temperature are minimized and maximum combustion chamber temperature may be achieved. The delivery of more air than is theoretically required adds to the total mass required to be heated and results in a temperature reduction. As a practical matter, however, some excess air is usually necessary to guarantee complete oxidation of all fuel components. The quantity of excess air required varies with burner designs but in any case, at least a minimum quantity of excess air is ordinarily necessary to provide complete combustion with an acceptable level of unburned products in the discharge gases.

Most modern combustion equipment includes a fuel-air ratio controller in an attempt to approach optimum combustion additions. However, variations such as the quality of fuel delivered to the combustion zone and ambient conditions will effect the combustion process. For example, the density of air may change quite considerably as a result of changes in barometric pressure, temperature, and humidity. Specifically, at 90° F., 90% relative humidity and a barometric pressure of 29.7 inches of water, there are approximately 0.0154 pounds of oxygen in each cubic foot of air. By comparison, at 50° F., 20% relative humidity and a barometric pressure of 30.5 inches of water, there are about 0.0179 pounds of oxygen in each cubic foot of air. The difference in oxygen in these two examples is 14%. It will be appreciated, therefore, that a boiler which is set to operate optimally on a hot humid day will receive more air than it requires on a day which is cooler and drier. This excess air reduces combustion efficiency by removing additional heat with the flue gas. Further, combustion efficiency is also affected by such variables in the fuel as viscosity, density, carbon-hydrogen ratio, and the water, ash and sulfur contents. Fuel-air metering devices which depend upon fixed mechanical relationships cannot effectively compensate for these variables.

There have been some previous attempts at adjusting the combustion air flow in accordance with measurements of oxygen in the discharged gases. These have usually taken the form of an adjustment in damper position to affect the quantity of air being admitted to the combustion chamber. The adjustment of air flow in this manner has not been wholly satisfactory, however, because of relatively non-uniform response during different portions of the operating cycle, particularly where the boiler employs a rotating or pivotable air damper element. For example, when such boilers are operating in a high fire mode, that is when a relatively large quantity of fuel is being delivered to the furnace and the damper is in a relatively open position, small changes in damper position will not materially affect the amount of air being admitted to the furnace. On the other hand, when the boiler is in a low fire mode wherein only a limited quantity of fuel is being delivered and the air damper is in a relatively closed position, small changes in damper position will affect a relatively large change in the percentage of additional air being delivered. For this reason, in systems which provide air flow adjustment for fuel-air ratio correction, the response to control signaling may be relatively slow at some operating levels and too fast at others, which results in hunting.

An additional shortcoming of the systems in which air flow volume is adjusted in accordance with sensed oxygen levels in discharged gases relates to the difficulty in rendering such systems fail-safe. For example, should the oxygen sensing system fail where damper control is employed, a fail-safe system would tend to return the damper to some neutral position. This position would have to be different for both low and high fire operations and in addition, the degree of correction in each case would also be different. Further, a return of the damper to a neutral position could result in either a lean or rich fuel mixture being delivered to the furnace.

SUMMARY OF THE INVENTION

It is an object of the invention to provide a new and improved fuel-air controller for combustion devices. Another object of the invention is to provide a fuel-air controller wherein the degree of adjustment necessary to provide the desired relation is not substantially different for either high or low fire operation. A further object of the invention is to provide a fuel air controller which is readily adaptable to fail-safe operation. Yet another object of the invention is to provide a fuel-air controller for combustion devices which maintains high combustion efficiency regardless of variations in fuel or air quality.

A still further object of the invention is to provide a fuel-air controller which adjusts the fuel-air ratio of a combustion device in relation to the level of sensed oxygen in fuel discharge gases.

These and other objects and advantages of the present invention will become more apparent from the detailed description thereof taken with the accompanying drawings.

DETAILED DESCRIPTION OF THE PREFERRED EMBODIMENT

Figure 1:
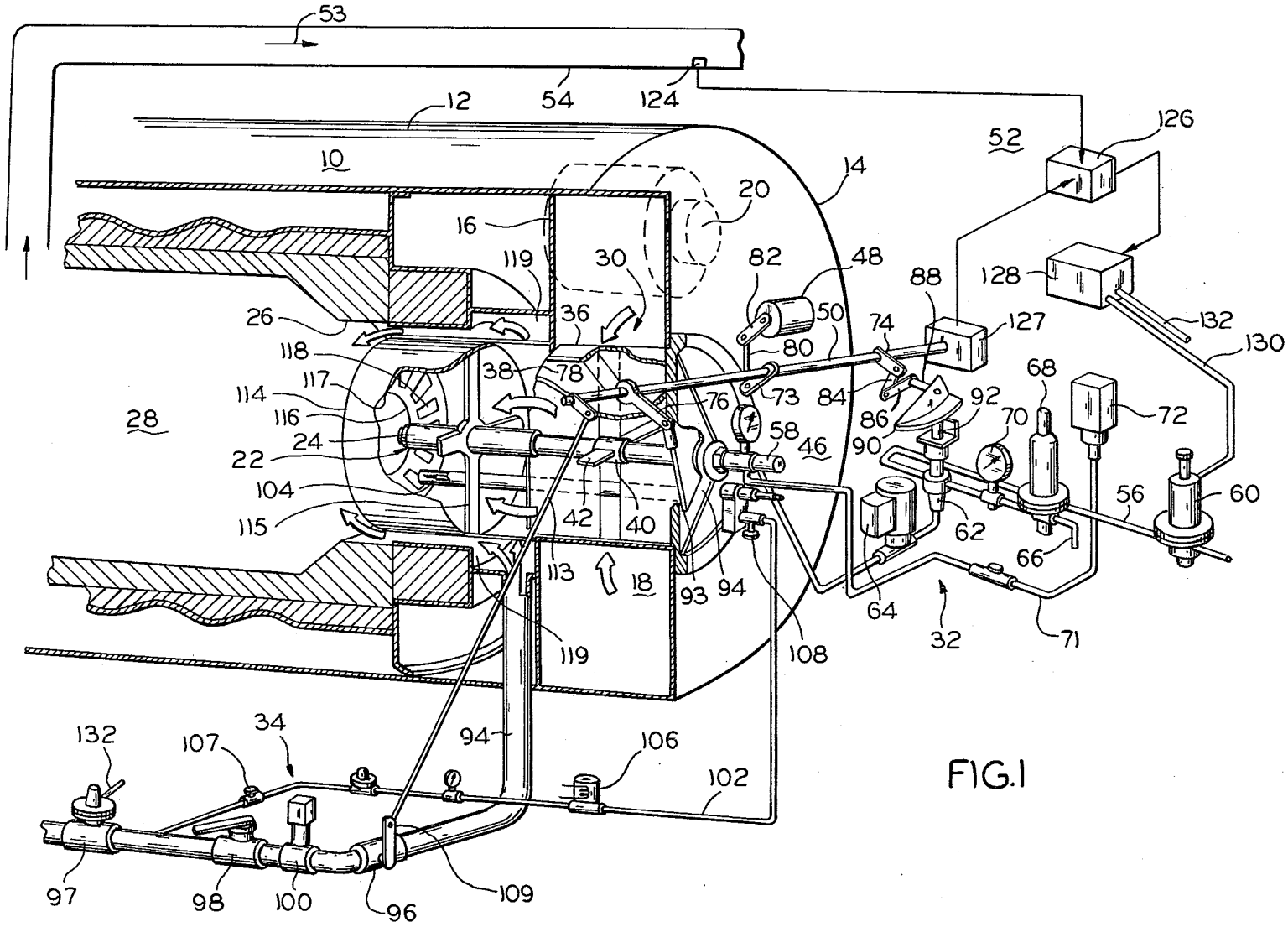
FIG. 1 schematically illustrates a boiler incorporating the fuel control system according to the present invention.

FIG. 1 illustrates a boiler 10 with which the control of the present invention is usable. It will be understood, however, that the control may have application to other types of combustion apparatus as well. The boiler 10 may be of any conventional type which includes an outer metallic shell 12 for enclosing water or fire tubes (not shown) through or around which water to be heated is circulated. A housing 14 may be affixed to the front of shell 12 for enclosing a fan 16 disposed in an annular plenum chamber 18. The fan 16 is driven by a suitable drive motor 20 and is operable to draw ambient air through an intake (not shown) for compression and delivery to the plenum chamber 18. A burner assembly 22 extends through plenum chamber 18 and has a nozzle 24 at its discharge end which is in registry with the inlet orifice refractory 26 of the boiler furnace 28. Disposed in surrounding relation to burner assembly 22 and within plenum chamber 18 is damper assembly 30 for controlling the volume of combustion supporting air being delivered to furnace 28.

Preferably, the burner assembly 22 is constructed and arranged for burning either oil or gas. Toward that end, an oil supply assembly 32 and a gas supply assembly 34 are each suitably connected to nozzle 24 in the manner well known in the art. The details of the burner assembly 22 form no part of the present invention and accordingly, will not be discussed in detail. It will be sufficient for purposes of understanding the invention, however, to state that the nozzle 24 includes means for receiving oil and atomizing air from the oil supply system 32 for suitably discharging atomized oil from nozzle 24 along with combustion supporting air from plenum 18. In addition, burner assembly 22 is provided with means for suitably mixing air from plenum 18 and gas delivered from the supply system 34.

While the damper assembly 30 may take any convenient form, in the illustrated embodiment it is shown to consist of an outer cylindrical housing 36 which is fixedly mounted in the plenum chamber 18 and an inner, cylindrical, concentrically mounted damper member 38 rotatably mounted within housing 36 in any suitable manner. For example, a central hub may be mounted on and surround nozzle 24 and a plurality of radial struts 42 may extend between hub 40 and the inner surface of damper 38. Housing member 36 and damper member 38 each have a plurality of spaced apart apertures (not shown) which occupy slightly less than one-half of their surface areas. When the member 38 is rotated within housing 36, the apertures (not shown) move into and out of registry. It will be appreciated, therefore, that the angular position of damper member 38 relative to housing 36 will determine the quantity of combustion air provided to the combustion chamber 28 from the plenum 18.

The position of damper 38 as well as the flow rate of oil or gas to the burner assembly 22 is determined by a control assembly 46. In general terms, the control assembly 46 includes a servo-motor 48 coupled to a cam shaft 50 which in turn is suitably coupled to the damper 38, the oil supply system 32 and the gas supply system 34 for suitably adjusting the same to achieve the desired combustion conditions. In order to correct for instantaneous variations in air or oil quality, control 46 also includes an auxiliary control assembly 52 which senses the free oxygen in the discharge gases 53 flowing in flue 54 and adjusts the delivery of fuel in relation thereto. Thus, even though the main control 48 may be set for optimum operating conditions, auxiliary control 52 corrects for deviations which result from variations in air or fuel quality.

The oil supply system 32 includes a supply conduit 56 suitably connected at one end to a supply source (not shown) and its other end to the manifold block 58 of burner assembly 22. Interposed in conduit 56 is a pressure reducing valve 60, a flow metering valve 62 and a solenoid valve 64. An oil return line 66 is also coupled to flow metering valve 62 and has interposed therein a pressure relief valve 68 and a pressure gauge 70. Atomizing air is provided to burner assembly 22 through conduit 71 under the control of an interlock which delivers air whenever fuel oil is flowing. In order to provide uniformity in fuel flow through metering valve 62, the pressure regulator 60 is provided upstream to maintain a relatively stable pressure at the input of valve 62.

In a conventional system, fuel oil is supplied to the burner 22 at some preselected pressure. A quantity of oil that is delivered through conduit 56 is controlled by metering valve 62 which in turn is actuated by shaft 50. Specifically, shaft 50 is journaled for rotation about a generally horizontal axis and has arms 73, 74, 76 and 78 radiating therefrom. The free end of arm 73 is coupled by a link 80 to an arm 82 mounted on the output shaft of a servo-motor 48. The servo-motor 48 is coupled to a control which is not shown but is well known in the art for receiving signals indicative of required changes in combustion conditions. In response to such signals, servo-motor 48 rotates arm 82 to reposition shaft 50. Coupled to the arm 74 is a second link 84, the other end of which is coupled to an arm 86 radiating from a shaft 88. Also mounted on shaft 88 is a cam segment 90 which engages the plunger 92 of metering valve 62. A third link 93 is connected at one end to arm 76 and at its other end to an arm 94 which is affixed to sleeve 40. It will be appreciated, therefore, that when servo-motor 48 operates to move arm 82, it will simultaneously adjust metering valve 62 and reposition the damper 38 to adjust the quantity of oil and air delivered to the combustion chamber 28. In this manner, the mechanical linkage attempts to provide an optimum air to fuel ratio to assure that the amount of excess air delivered to the furnace 28 is not substantially in excess of that required for complete combustion.

The gas supply system 34 includes a supply conduit 94 connected at one end to a suitable supply source and which is connected at its opposite end to the furnace 28. Interposed in conduit 94 is a metering valve 96, a pressure regulating valve 97, a shut-off valve 98 and a main valve 100. Also coupled to supply conduit 94 on the upstream side of valve 100 is a pilot supply conduit 102. The opposite end of pilot supply conduit 102 is connected to a gas pilot 104 which is spark ignited for initiating both gas and oil firing. A solenoid valve 106 is interposed in pilot supply conduit 102 along with shut-off valves 107 and 108. The gas modulating valve 96 also includes an arm 109 which is coupled by link 113 to the arm 78 mounted on shaft 50. Accordingly, rotation of shaft 50 by motor 48 will also meter the flow of gas to burner 22. The modulating valve 97 controls the pressure of gas supplied to the main valve 96 in a manner similar to that of the oil supply system 32. With a constant gas pressure applied to metering valve 96, the latter is adjusted by movement of an arm 109 to control the quantity of gas delivered from pipe 94 to burner 22. This adjustment is coordinated with adjustments of damper 38 as discussed hereinabove.

The air delivery system includes a drum 114 which surrounds the end of burner 22 and is maintained in spaced relation thereto by spokes 115. Drum 114 is open at its end facing damper 38 and is aligned therewith for receiving combustion air therefrom. A baffle wall 116 is provided at the other end of drum 114 and has a central opening 117 spaced coaxially from nozzle 24 and finned openings 118 to impart the desired flow pattern to the combustion air. The terminal end of conduit 94 is connected to a plenum chamber 119 which surrounds drum 114 for delivering gaseous fuel to the furnace 28 from around the periphery of drum 114. It will be appreciated that normally the gas and oil will be delivered to the furnace 28 alternately.

The auxiliary control 52 includes an oxygen sensor 124 disposed in flue 54 and constructed and arranged to sense the level of free oxygen in the flue gases and for supplying a signal functionally related thereto to a comparison circuit 126. Also connected to the circuit 126 is a selector switch 127 adapted to set the comparison circuit in a high-fire or low-fire state in relation to the angular position of shaft 50. Comparator 126 compares the signal from oxygen sensor 124 to a desired oxygen level for the indicated position of shaft 50. An electro-pneumatic transducer 128 is coupled to receive a correction signal from comparator 126 and for supplying a pneumatic signal in response thereto to pneumatic supply lines 130 and 132 which are respectively connected to modulators 60 and 97.

Figure 2:
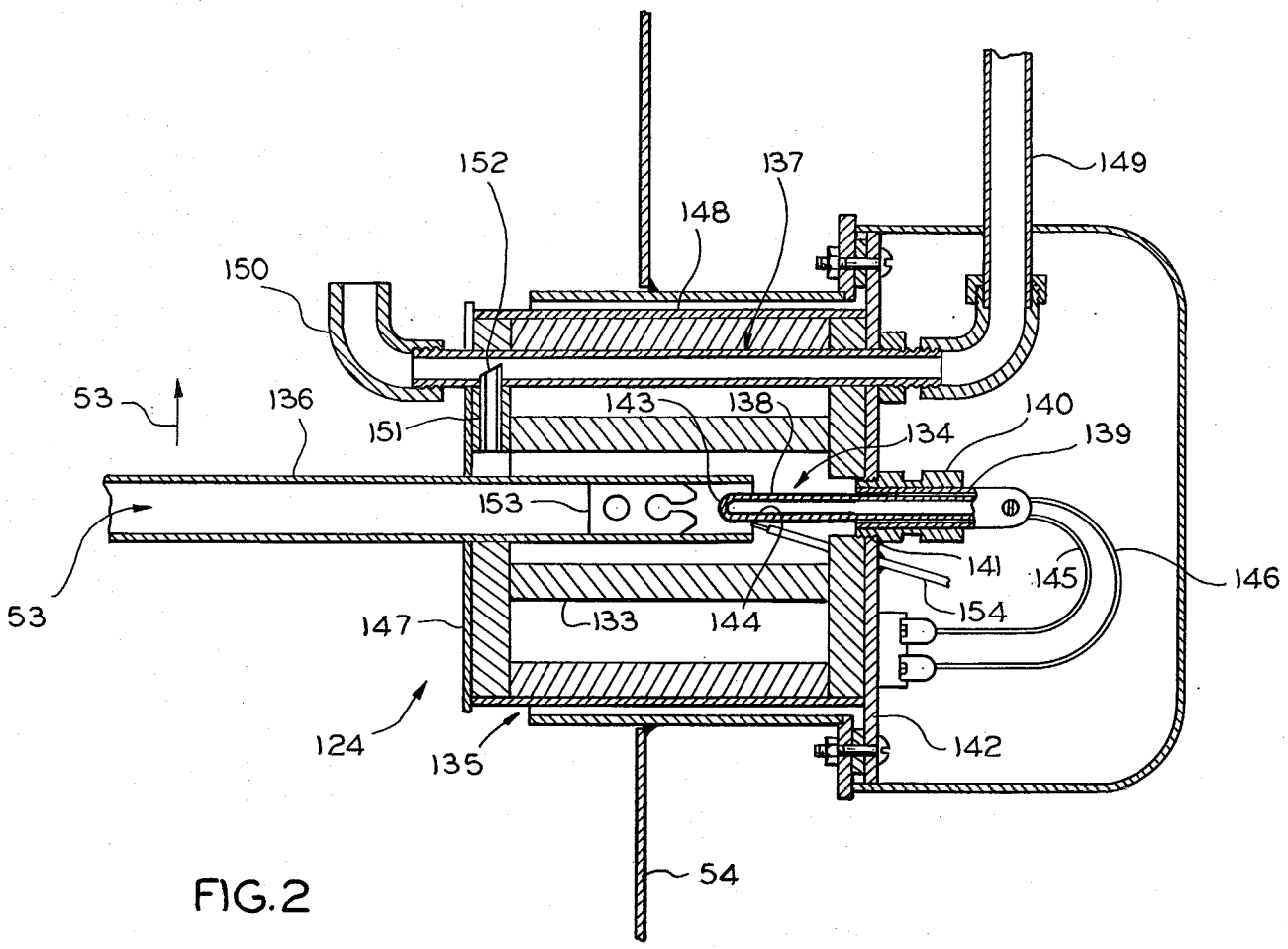
FIG. 2 schematically illustrates an oxygen sensor employed with the apparatus of FIG. 1.

Any conventional oxygen sensor may be employed such as the zirconium oxide ceramic type shown in FIG. 2. Specifically, the illustrated sensor 124 includes a probe 134 mounted in a support housing 135 which is suitably affixed in the wall of flue 54. In addition to the probe 134, the sensor includes a sample tube 136, a flue gas aspirator 137 and a heater 133.

The probe 134 includes a thin walled shell of zirconium oxide ceramic 138 which is suitably mounted in a cylindrical stainless steel sheath 139. A nut 140 is affixed to the sheath 139 and has a threaded portion for being received in a threaded aperture 141 formed in the front wall 142 of housing 135. A first metallic electrode 143 is disposed on the outer surface of tube 138 and a second electrode 144 is disposed on the inner surface thereof. Both electrodes 143 and 144 may comprise, for example, a platinum paint affixed to the respective surfaces of tube 138. Leads 145 and 146 may be connected to the electrodes 143 and 144, respectively, for connecting the same to the comparison circuit 126 as will be described more fully below.

The sample tube 136 is positioned in the front wall 147 of housing 135 and in a coaxial relation relative to the tube 138 of probe 134. The diameter of tube 136 is greater than that of tube 138 and its inner end is disposed in a spaced apart surrounding relation to tube 138 while its outer end is disposed in the flue gas stream 53. The flue gas aspirator 137 includes a first tube 148 extending through housing 135 in general parallelism with tube 136. One end of tube 148 is connected to an inlet tube 149 whose other end is exposed to receive aspirating air. At the other end of tube 148 there is an outlet tube 150 and which opens into the flue gas stream 53. A connecting tube 151 extends between the interior of housing 135 and tube 148 and its end 152 has an angle cut which faces in the upstream direction. It will be appreciated that the aspirating air flowing through tubes 148, 149 and 150 will aspirate a sample of the gas into tube 136 for movement therein to the probe 138 before being drawn through pipe 151 into tube 148 for exit along with the aspirating air. A nozzle 153 is disposed in tube 136 adjacent probe 134 to direct the flow of sample gas as it flows against tube 138.

The zirconium oxide ceramic tube is not only relatively strong so as to provide structural strength but is able to conduct oxygen ions when heated above about 1200° F. It is impermeable, however, to other gases. As indicated previously, the flue gas is passed over the outer end of the tube while the inside of the tube contains fresh air. The difference in concentration of oxygen between the inside and outside of the tube 138 produces a small voltage difference across the electrodes 143 and 144 which is utilized in the comparison circuit 126 as will be discussed below.

Because the signal generated by sensor 124 is a function of the temperature of the sensor and the gas sample, the sample and sensor are maintained at 1300° F. plus or minus 10° F. This may be accomplished in any conventional manner such as by means of theremocouple 154 positioned to be exposed to the flue gas sample and which is operative to control the heater 138 which is generally tubular and disposed in surrounding relation to the probe 134 and the end of the gas sample tube 136.

Figure 3:
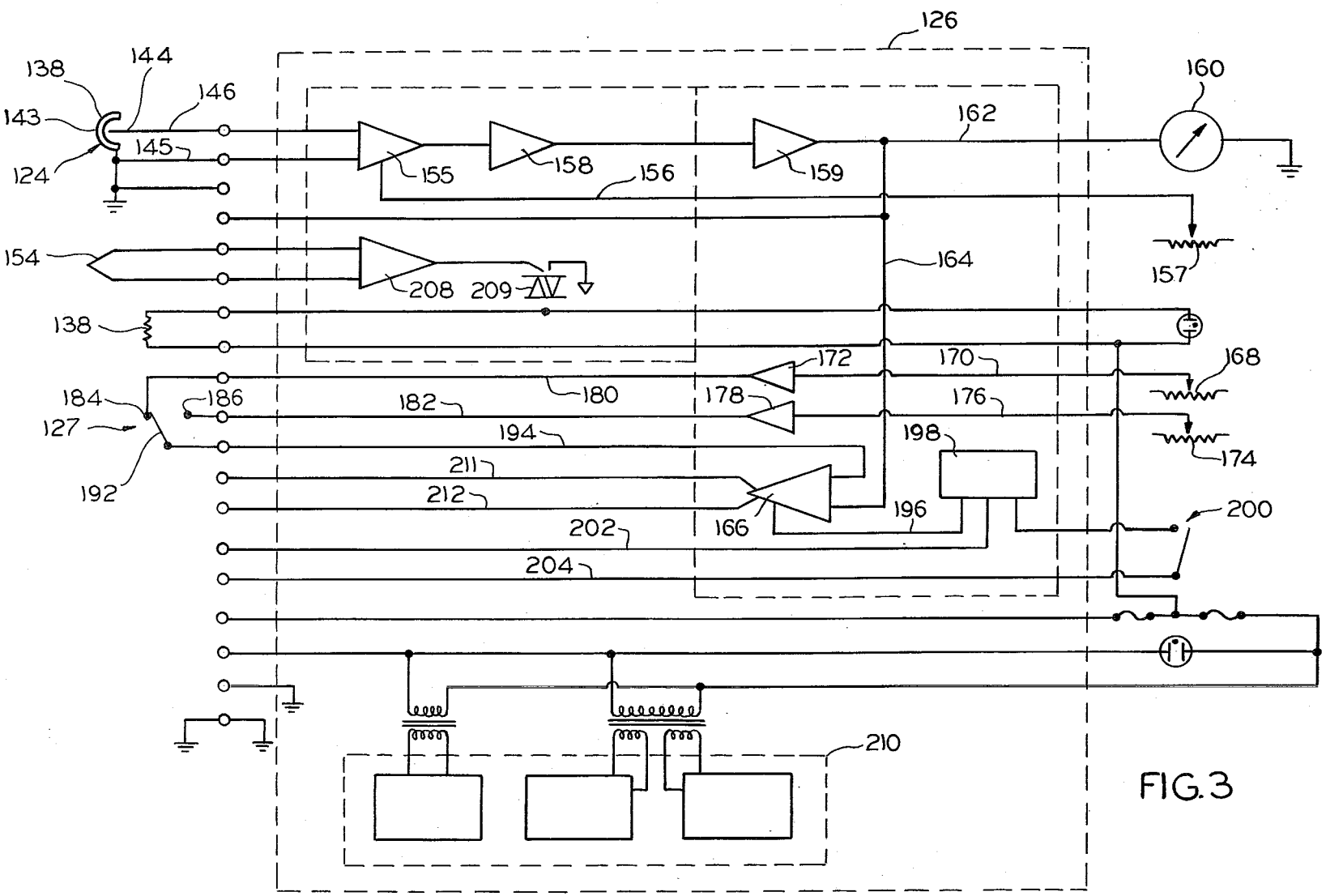
FIG. 3 schematically illustrates electrical control circuitry employed with the apparatus of FIG. 1.

The comparison circuit 126 is shown in FIG. 3 to include an operational amplifier 155 coupled to receive the signal from oxygen sensor 124 through leads 145 and 146. The signal from sensor 124, which is in the milla-volt range, is thereby amplified to the range of 0 to 10 volts. Amplifier 155 is also coupled by conductor 156 to a zero adjust potentiometer 157 to compensate for the very slight offset voltage from the probe 138 when it is exposed to air on both sides.

The output signal from amplifier 155 is delivered to an integrator 158. The integrated signal from integrator 158 is delivered to a driver 159 whose output is coupled to a panel meter 160 by conductor 162 so that the oxygen level in discharge gases 53 will be displayed to an operator.

In addition, the output of driver 159 is connected by conductor 164 to an oxygen controller 166. Also connected to controller 166 is a set point trim circuit consisting of a low fire set point potentiometer 168 connected by conductor 170 to a first driver 172 and a high fire set point potentiometer 174 connected by conductor 176 to a second driver 178. The outputs of drivers 172 and 178 are respectively conducted by conductors 180 and 182 to the contacts 184 and 186 of selector switch 126. The arm 192 of switch 126 is connected by conductor 194 to oxygen controller 166 and is positioned by the cam shaft 50. Depending upon the position of switch arm 192, the controller 166 compares the signal from driver 158 to the high or low fire set point signals and provides a fuel control signal which is functionally related to the difference therebetween.

Oxygen controller 166 is inhibited from providing an output signal except when an enable signal is provided through conductor 196 from a timer 198. In turn, the timer 198 is operative to provide an output signal on conductor 196 only when a manually operated selector switch 200 is closed and an interlock signal is received on conductors 202 and 204 indicating that the appropriate fuel valves are open.

The thermocouple 154 is connected to an operational amplifier 208 whose output is used to control a heater 138. The gas sample 53 and probe 124 are thereby maintained at the desired temperature.

The amplifer 166 is connected by conductors 211 and 212 to the input of an electromagnetic transducer 128. While any suitable electromagnetic transducer may be employed, one such device is the type 546 Electromagnetic Transducer manufactured by Fisher Controls Company. This device adjusts a pneumatic output in accordance with the level of a received electrical signal. Accordingly, if the oxygen level in the discharge gas 53 differs from a desired level, the corrective signal is provided from oxygen controller 166 to the electromagnetic transducer 128. This signal is reflected in a pressure change in a pneumatic output signal delivered to conduits 130 or 132.

Figure 4:
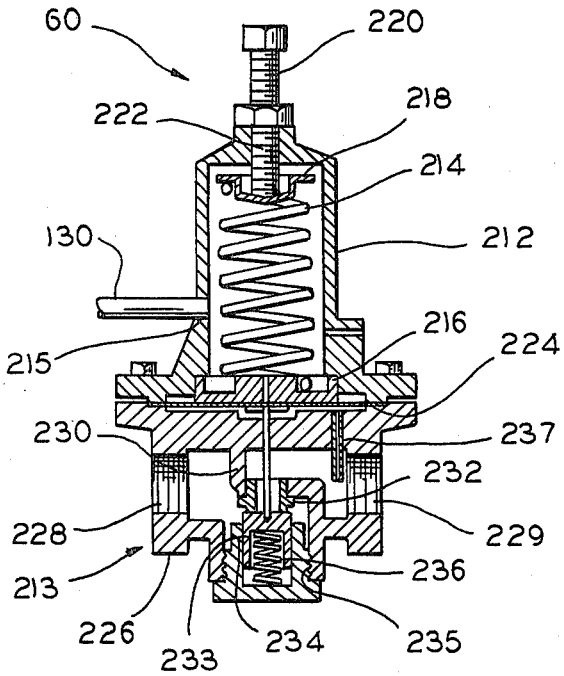
FIG. 4 schematically illustrates an oil controller employed with the apparatus of FIG. 1.

The fuel oil pressure regulator 60 is shown in FIG. 4 to include a vertically oriented cylinder 212 coupled to a regulator 213 which encloses an axially extending spring 214. Cylinder 212 is hollow and has an inlet 215 coupled to the conduit 130 for receiving air under pressure in accordance with the level of oxygen in discharge gas 53. An axially oriented compression spring 214 is disposed within cylinder 212 and one end engages a piston 216 disposed in the cylinder's lower end. The other end of spring 214 is engaged by an adjusting plate 218 against which bears the lower end of an adjusting nut 220 threadably received in and extending axially through a threaded opening 222 in the upper end of the cylinder 212. The lower end of cylinder 212 is sealed by a diaphragm 224 whose outer edges are clamped between the mating flanges by which cylinder 212 and regulator 213 are attached.

The regulator 213 includes a housing 226 having an inlet 228 and an outlet 229. Between inlet 228 and outlet 229 is a partition 230 in which a valve seat 232 is disposed. A valve element 233 is provided for cooperation with seat 232 and is affixed to the lower end of a piston rod extending downwardly from piston 216. Element 233 is also slidably received within a sleeve 234 threadably mounted in an opening 235 in the lower end of housing 226 and a spring 236 is disposed within sleeve 234 for engaging the underside of valve element 233. A passage 237 connects outlet 229 to the underside of diaphragm 224 to the outlet pressure to balance the force of spring 214 so that element 233 is normally held in a neutral position relative to seat 232. The additional force on piston 216 and diaphragm 224 resulting from the pneumatic pressure within cylinder 212 introduced through conduit 130 will act to reposition member 234 thereby producing the desired pressure regulation.

The oil controller shown in FIG. 4 provides relatively linear changes in outlet pressure with respect to movement of valve element 234 relative to seat 232. This permits relatively rapid response for both high and low fire operation. Also in the event of a failure in the oxygen sensing system, there would be a reduction in pressure in line 130. This would return valve element 233 to a neutral position wherein the oil supply system would operate as though the auxiliary control assembly 52 was not present. This facilitates fail safe operation.

Figure 5:
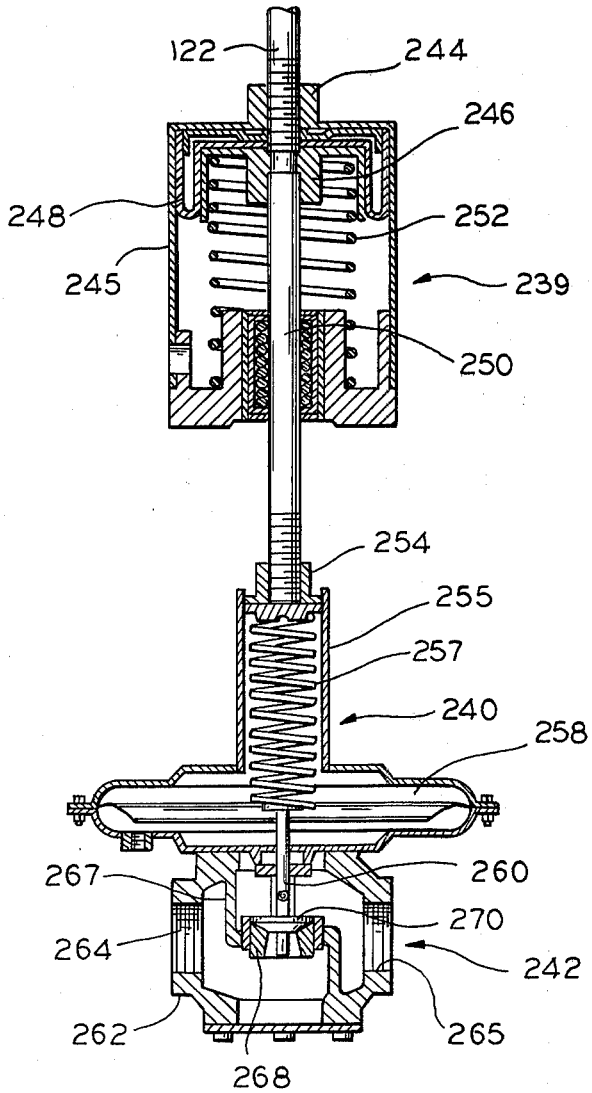
FIG. 5 schematically illustrates a gas controller employed with the apparatus of FIG. 1.

The gas modulating valve 97 is shown in FIG. 5 and includes control 239, a housing 240 and a valve 242. A nipple 244 in the upper end of control 239 is coupled to pneumatic control line 132 so that a pressure is delivered to control 239 which is functionally related to the level of oxygen in discharge gas 53.

The control 239 includes a cylinder 245 having a coaxially mounted piston 246 which engages one side of a diaphragm 248 which extends across the upper end of the cylinder. The other surface of the diaphragm 248 is exposed to the nipple 244. A piston rod 250 extends coaxially through cylinder 245 and outwardly through its lower end. In addition, a spring 252 coaxially surrounds the rod 250 and extends between the other side of cylinder 245 and the underside of piston 246. The lower end of rod 250 is threadably received in a piston 254 slidably disposed in a neck 255 extending upwardly from housing 240. The piston 254 engages the upper end of the spring 257 disposed in neck 255, the lower end of which engages a diaphragm 258 extending across housing 240. A rod 260 is affixed at its upper end to diaphragm 258 and extends axially toward the lower end of housing 240.

The valve 242 includes a housing portion 262 affixed at its upper end to housing 240. Also formed in housing 262 is a gas inlet 264 and a gas outlet 265. Disposed between inlet 264 and outlet 265 is a partition 267 having a valve seat 268 axially aligned with rod 260. Disposed on the lower end of rod 260 is a valve element 270. Gas pressure at the outlet 265 acting on diaphragm 258 maintains valve element 270 in a neutral position. It will be appreciated that pneumatic pressure delivered to the upper end of cylinder 245 of control 239 and acting on piston 246 and diaphragm 248 acts to reposition valve element 270 with respect to seat 268 thereby regulating the pressure between inlet 264 and outlet 265.

While the invention has been illustrated and described with respect to a boiler, it will be appreciated that it has application to other types of combustion devices as well. In addition, while specific fuel control valves have been described, these are intended to be exemplary. Accordingly, it is not intended to limit the invention to the foregoing specification but to the scope of the appended claims.

We claim:

1. A combustion device including a combustion chamber having an exhaust, first means for delivering fuel to said combustion chamber, second means for delivering air to said combustion chamber, third means coupled to said first and second means for regulating the ratio of fuel and air delivered to said combustion chamber, oxygen sensing means disposed in said exhaust for sensing the level of oxygen in the gaseous combustion products exhausting from said combustion chamber and for producing a signal functionally related thereto, comparison means for sensing said signal and for determining the deviation thereof from a preselected value, said comparison means being operative to produce an output signal functionally related to said deviation, fuel modulating means coupled to said first means, said fuel modulating means being connected to receive said output signal and being operative to modulate the flow of fuel to said combustion chamber in response to changes in said output signal.

2. The combustion device set forth in claim 1 wherein said comparison sensing means includes level adjustment means for adjusting said output signal to provide high and low fire conditions.

3. The combustion device set forth in claim 1 wherein said fuel modulating means includes a movable member and a fixed member and positioning means operative to position said movable member relative to said fixed member in relation to said output signals, the degree of movement of said movable member necessary to effect a correction being substantially the same for high and low fire operation.

4. The combustion device set forth in claim 3 and including an electro-pressure transducer coupled to receive the signal from said oxygen sensing means and to provide a pressure signal functionally related thereto, said fuel modulating means including a pressure responsive flow controller connected to said first means and operative in response to said pressure signal for modulating the flow of fluid to said combustion chamber.

5. The combustion device set forth in claim 4 and including a nozzle disposed in said combustion chamber, said first means including a fuel oil delivery system coupled to said nozzle and including valve means for controlling the rate of fuel oil delivery to said nozzle, said second means including an adjustable damper for controlling the flow of air to said combustion chamber, said third means being coupled to said valve and to said damper for regulating the ratio of fuel and air delivery to said combustion chamber.

6. A method of controlling a combustion process, the steps of delivering fuel to a combustion chamber, delivering air to said combustion chamber, regulating the ratio of fuel and air delivered to said combustion chamber, sensing the level of oxygen in the gaseous combustion products exhausting from said combustion chamber, modulating the delivery of said fuel to said combustion chamber in relation to the level of oxygen sensed in said discharge gases.

7. The method set forth in claim 6 wherein the level of oxygen in said discharge gases is compared to a preselected desired oxygen level, and the flow of fuel to said combustion chamber is modulated in accordance with the deviation of said oxygen from the desired level.

8. The method set forth in claim 7 wherein said fuel is fuel oil.

9. The method set forth in claim 7 wherein said fuel is gaseous.

10. The method set forth in claim 6 wherein said combustion process may be operated in high and low fire conditions, said fuel delivery modulation being substantially linear for changes in oxygen levgel for both high and low fire conditions.

11. A compression device including a combustion chamber having an exhaust, fuel delivery means for delivering fuel to said combustion chamber including a fuel controller for controlling the rate of fuel delivery to said combustion chamber, air delivery means for delivering air to said combustion chamber and including damper means for controlling the rate of air delivery to said combustion chamber, a fuel-air ratio controller coupled to said damper means and to said fuel controller for regulating the ratio of air and fuel delivered to said combustion chamber, oxygen sensing means disposed in said exhaust for sensing the level of oxygen in the gaseous combustion products exhausting from said combustion chamber and for producing a signal functionally related thereto, comparison means connected to said oxygen sensing means for receiving said signal and for determining the deviation thereof from a preselected value, said comparison means being operative to produce an output signal functionally related to said deviation, fuel modulating means coupled to said fuel delivery means and connected to receive said output signal and being operative to adjust the flow of fuel to said combustion chamber in response to changes in said output signal.

12. The combustion device set forth in claim 11 wherein said comparison means includes level adjustment means to modify said output signal and to provide a first output signal for high fire conditions and a second output signal for low fire conditions, said fuel modulating means being substantially linearly responsive to changes in said first or second output signals.

* * * * *